US008708443B2

(12) United States Patent
Kubo et al.

(10) Patent No.: US 8,708,443 B2
(45) Date of Patent: Apr. 29, 2014

(54) ELEMENT SUBSTRATE, PRINTHEAD, HEAD CARTRIDGE, PRINTING APPARATUS, AND METHOD FOR CONFIRMING ELECTRICAL CONNECTION STATUS OF PRINTHEAD AND PRINTING APPARATUS

(75) Inventors: Kousuke Kubo, Yokohama-shi (JP); Yoshiyuki Imanaka, Kawasaki-shi (JP); Koichi Omata, Kawasaki-shi (JP); Souta Takeuchi, Yokohama-shi (JP); Takaaki Yamaguchi, Yokohama-shi (JP)

(73) Assignee: Canon Kabushiki Kaisha, Tokyo (JP)

( * ) Notice: Subject to any disclaimer, the term of this patent is extended or adjusted under 35 U.S.C. 154(b) by 235 days.

(21) Appl. No.: 13/212,887

(22) Filed: Aug. 18, 2011

(65) Prior Publication Data

US 2011/0304664 A1 Dec. 15, 2011

Related U.S. Application Data

(63) Continuation of application No. 12/132,465, filed on Jun. 3, 2008, now Pat. No. 8,020,956.

(30) Foreign Application Priority Data

Jun. 4, 2007 (JP) ..... 2007-148616

(51) Int. Cl.
*B41J 29/38* (2006.01)

(52) U.S. Cl.
USPC ..... 347/12

(58) Field of Classification Search
USPC ..... 347/12
See application file for complete search history.

(56) References Cited

U.S. PATENT DOCUMENTS

2005/0190222 A1 * 9/2005 Nakajima et al. ..... 347/14

* cited by examiner

*Primary Examiner* — Uyen Chau N Le
*Assistant Examiner* — Hoang Tran
(74) *Attorney, Agent, or Firm* — Canon USA Inc. IP Division

(57) ABSTRACT

An element substrate capable of independently confirming an electrical connection status with a logic power source without increasing costs due to increasing the number of terminals or the like. The element substrate includes a connection status output circuit that outputs a signal in response to a connection status of a logic power source input terminal, or a connection status of input terminals of each of a print signal, a clock signal, a drive signal, and a latch signal, and a connection status output terminal that outputs an output signal from the connection status output circuit.

6 Claims, 10 Drawing Sheets

ELEMENT SUBSTRATE, PRINTHEAD, HEAD CARTRIDGE, PRINTING APPARATUS, AND METHOD FOR CONFIRMING ELECTRICAL CONNECTION STATUS OF PRINTHEAD AND PRINTING APPARATUS

CROSS-REFERENCE TO RELATED APPLICATIONS

This application is a continuation of U.S. patent application Ser. No. 12/132,465 filed Jun. 3, 2008, which claims the benefit of Japanese Patent Application No. 2007-148616, filed Jun. 4, 2007, all of which are hereby incorporated by reference herein in their entirety.

BACKGROUND OF THE INVENTION

1. Field of the Invention

The present invention relates to an element substrate for a detachable printhead having a connection status output circuit that outputs a signal in response to an electrical connection status of a printhead and a printing apparatus. Furthermore, it relates to a printhead, a head cartridge, a printing apparatus, and methods for confirming an electrical connection status of a printhead and a printing apparatus.

2. Description of the Related Art

Techniques that use an electromechanical transducer such as a piezoelectric element and techniques in which ink is heated using an electrothermal transducer (heater) to discharge an ink droplet using a film boiling effect are known as typical ink discharge techniques of printheads that are mounted in an inkjet printing apparatus.

A printing apparatus provided with the aforementioned inkjet printhead is capable of outputting high quality text and images at low cost. In particular, a printer in which ink droplets are discharged using a film boiling effect have an advantage in being capable of carrying out color printing at low cost and therefore hold a major share of the market.

Due to a tendency to improve image quality, the number of discharge orifices of a printhead has generally increased from 64 to 128 outlets, or even 256 outlets or the like, which are arranged in a high density manner having a number of discharge orifices per inch (dpi) of 300 dpi or 600 dpi for example. The heaters arranged as electrothermal transducers for the respective discharge orifices form respective bubbles due to film boiling with heat pulses of a several microsecond order to a 10 microsecond order. By driving at high frequencies in this manner, high image quality prints can be achieved at high speed.

Means for electrically connecting the printhead in the inkjet printing apparatus is provided in a carriage in which the printhead is mounted and conveyed reciprocally. Specifically, a plurality of contact points are provided in the carriage which are made to respectively contact a plurality of contact points provided on the printhead when the printhead is mounted in the carriage. In this manner, electrical connection is achieved between the printhead and the inkjet printing apparatus.

Exchangeable printheads are commonly designed to be replaced by a user, and in an inkjet printing apparatus that uses the printhead integrated with an ink tank, a new printhead is mounted each time the ink is exhausted. An electrical connection between the printhead and the inkjet printing apparatus is established each time a printhead is replaced with a new printhead by a user, and therefore it is preferable to monitor the electrical connection status between the printing apparatus and the printhead. U.S. Pat. No. 5,828,386 discloses a printhead and an inkjet printing apparatus that are provided with means for monitoring the electrical connection status. This relates to a print signal that is supplied from the printing apparatus to an input terminal of the printhead, a clock signal for transferring the print signal, and a control signal for enabling a printing operation in response to the print signal. U.S. Pat. No. 5,828,386 involves a configuration provided with an AND circuit that performs computation on a logical product of these three signals, and an output terminal for outputting a result of the computation.

FIG. 3 is one example of a conventional connection status output circuit. Here, there are a print signal (DATA), a clock signal (CLK), a drive signal (HE) for driving a heater, and a latch signal (LT) for latching the print signal in a latch circuit (not shown). The logical product of these signals undergoes computation in the AND circuit, and a computation result is outputted by a connection status output terminal (CNO). A CNO signal is high only when the latch signal, the drive signal, the print signal, and the clock signal are all high. Accordingly, the electrical connection between the printhead and the printing apparatus is confirmed when all the input signals are inputted at high level at a certain arbitrary timing from the printing apparatus and the CNO signal is outputted at high level. In this manner, it is possible to confirm whether or not the printhead is connected properly to the printing apparatus, and therefore it is possible to prevent printing problems such as missing print dots, and damage to the printhead originating in contact point problems.

Furthermore, U.S. Publication No. 2007/0002087 discloses a circuit and a terminal that output a connection status of a CLK signal, a DATA signal, an LT signal, and an HE signal.

In this regard, a printhead designed to be capable of being replaced by the user will be touched directly by the user at times such as during replacement. For this reason, for example when static electricity is produced when the printhead is touched directly by the user, an electric current of that static electricity will be supplied to the element substrate via the terminals of the printhead and the wiring, and portions of the element substrate susceptible to the static electricity may be damaged. Thus, it is necessary to adopt a technique such that damage is not inflicted on the element substrate.

A configuration in which an electrostatic protection element constituted by a diode is inserted between the input portion of the print signal and the power line and ground line respectively are commonly implemented as resolving means. In this way, the electric current that flows in as static electricity is distributed and flows out to the power line and the ground line, thereby improving the robustness of the element substrate against static electricity.

However, a printhead that can enable confirmation of its electrical connection status and in which an electrostatic protection element is provided has problems such as the following. When signals being high level are inputted from signal terminals during a confirmation of the electrical connection, an electric current may flow undesirably to the power line through the electrostatic protection element. When the electric current flows undesirably to a logic power source (VDD) that is a power line, the connection of the VDD terminal alone may not be able to be confirmed. FIG. 2 shows a configuration example of an electrostatic protection circuit in which diodes are used as an electrostatic protection element. The diodes, which are an electrostatic protection element, are provided near a print signal input pad at the VDD line side and the ground side, respectively. With this configuration, the electric current that flows in as static electricity is distributed externally and flows out. Here, a voltage of 3.3 V, for example, is applied to each print signal terminal when confirming the electrical connection status. However, even if the VDD terminal has a connection problem, a voltage of approximately 2.6 V is supplied through the diode to the VDD line, and therefore this voltage is confirmed as a VDD voltage when confirming the electrical connection status. There is no problem if connection to the VDD terminal is established and electricity flows. However, if a heater driving voltage VH (for example, 24 V) is applied while the VDD terminal has a connection problem, there is a risk that the printhead will be damaged due to malfunction of the heater caused by an operation of the logic circuit being indefinite. Accordingly, in a printhead having both an electrical connection output circuit and an electrostatic protection circuit, it is preferable that this is configured to enable the electrical connection status of the logic power source to be confirmed independently in order to provide greater reliability. Although U.S. Publication No. 2007/0002087 discloses a circuit and a terminal that output a connection status of the CLK signal, the DATA signal, the LT signal, and the HE signal, it is not a configuration that enables the electrical connection status of the logic power source to be confirmed independently.

SUMMARY OF THE INVENTION

The present invention is directed to an element substrate, a printhead, a head cartridge, a printing apparatus, and a method for confirming electrical connection status of the printhead and the printing apparatus.

The element substrate is capable of independently confirming an electrical connection status between a printhead and a printing apparatus using that printhead, in particular, capable of confirming an electrical connection status with a logic power source.

According to one aspect of the present invention, there is provided an element substrate comprising:

a plurality of printing elements;

a print signal input terminal inputting a print signal;

a clock signal input terminal inputting a clock signal for transferring the print signal;

a drive signal input terminal inputting a drive signal for controlling driving of the printing elements;

a latch signal input terminal inputting a latch signal for latching the print signal in a latch circuit;

a logic circuit controlling driving of the printing elements in accordance with the drive signal;

a logic power source input terminal allowing inputting a voltage to be applied to the logic circuit;

an NMOS transistor having a drain connected to the logic power source input terminal via a resistor, a source connected to a ground, and a gate receiving a signal based on voltages supplied from the print signal input terminal, the clock signal input terminal, the latch signal input terminal, and the drive signal input terminals;

a connection status output circuit configured to output a signal in accordance with a connection status of the logic power source input terminal, or a connection status of each of the print signal input terminal, the clock signal input terminal, the latch signal input terminal, and the drive signal input terminals, based on the output of the NMOS transistor; and a connection status output terminal configured to supply the signal output by the connection status output circuit to outside of the substrate, wherein the signal output via the connection status output terminal is outputted by undergoing voltage division between the logic power source input terminal and the drain and between the drain and the source, and wherein the signal is outputted in accordance with a level of the signal supplied to the gate, and is either a signal having a first level based on a voltage applied to the logic power source input terminal, or a signal having a second level based on the voltages inputted to the signal input terminals.

According to another aspect of the present invention, there is a printhead, a head cartridge, and a printing apparatus provided with the element substrate, and a method for confirming an electrical connection status of the printhead and the printing apparatus.

According to still another aspect of the present invention, there is provided a printhead comprising:

a plurality of printing elements;

a print signal input terminal inputting a print signal;

a clock signal input terminal inputting a clock signal for transferring the print signal;

a drive signal input terminal inputting a drive signal for controlling driving of the printing elements;

a latch signal input terminal inputting a latch signal for latching the print signal in a latch circuit;

a logic circuit controlling driving of the printing elements in accordance with the drive signal;

an element substrate having a logic power source input terminal allowing inputting a voltage to be applied to the logic circuit, wherein the element substrate comprising:

an NMOS transistor having a drain connected to the logic power source input terminal via a resistor, a source connected to a ground, and a gate receiving a signal based on voltages supplied from the print signal input terminal, the clock signal input terminal, the latch signal input terminal, and the drive signal input terminals;

a connection status output circuit configured to output a signal in accordance with a connection status of the logic power source input terminal, or a connection status of each of the print signal input terminal, the clock signal input terminal, the latch signal input terminal and the drive signal input terminals, based on the output of the NMOS transistor; and a connection status output terminal configured to supply the signal output by the connection status output circuit to outside of the substrate, wherein the signal output via the connection status output terminal is outputted by undergoing voltage division between the logic power source input terminal and the drain and between the drain and the source, and wherein the signal is outputted in accordance with a level of the signal supplied to the gate, and is either a signal having a first level based on a voltage applied to the logic power source input terminal, or a signal having a second level based on the voltages inputted to the signal input terminals.

The invention is particularly advantageous since it is possible to provide an element substrate capable of independently confirming an electrical connection status with a logic power source without increasing costs due to increasing the number of terminals or the like. Furthermore, a printhead, a head cartridge, and a printing apparatus that are provided with the element substrate can be provided.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Numerous embodiments of the present invention will now herein be described below in detail with reference to the accompanying drawings. The following embodiments are not intended to limit the claims of the present invention.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

It should be noted that "element substrate" used in the description does not indicate a simple base structure constituted by a silicon semiconductor, but indicates a base structure on which various elements and circuitry and the like are arranged.

"On the element substrate" does not indicate merely on a surface of the element substrate, but indicates on a surface of the element substrate and also internal sides of the element substrate near the surface. "Built-in" referred to in the present invention is not a term indicating that elements of a separate structure are simply arranged on a base structure, but indicates that the elements are integrally formed and manufactured on the element substrate through a manufacturing process or the like of a semiconductor circuit.

FIG. 6 to FIG. 10 are explanatory diagrams for describing printheads (head cartridges) according to the exemplary embodiment of the present invention. Description is given below regarding various structural elements with reference to these diagrams.

Figure 6B:
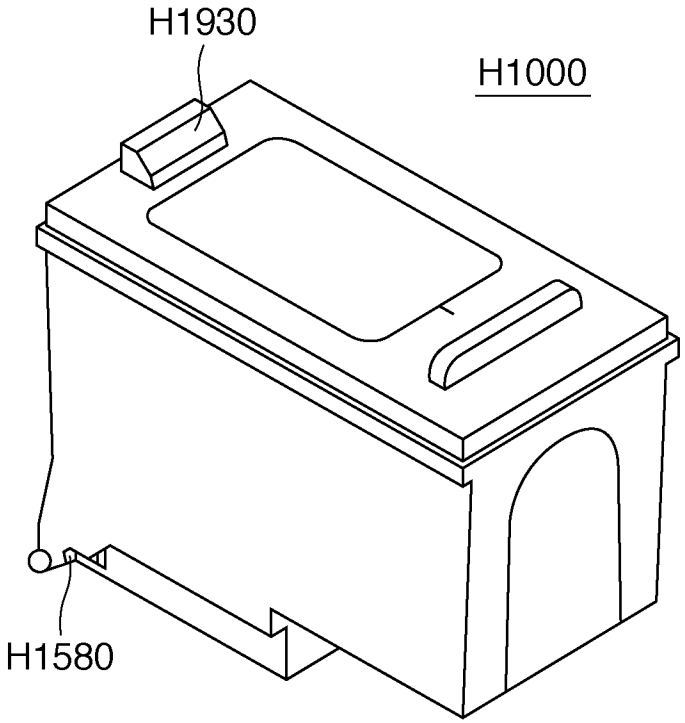
FIG. 6B depicts a perspective view of the first printhead according to the exemplary embodiment of the present invention, as viewed laterally from above.
Figure 6A:
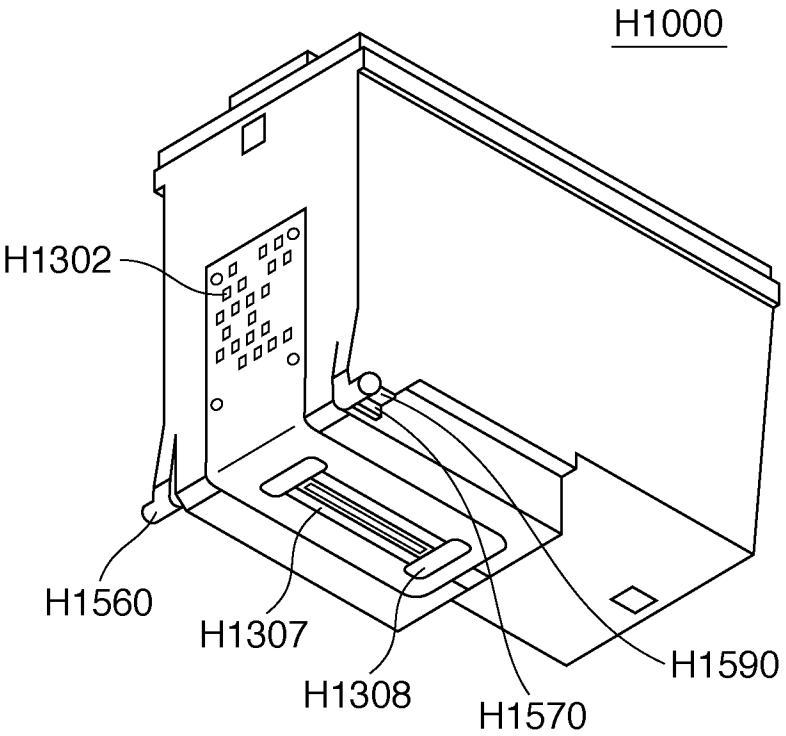
FIG. 6A depicts a perspective view of a first printhead according to the exemplary embodiment of the present invention, as viewed laterally from the head.

A printhead according to the exemplary embodiment is integrated with an ink tank that contains ink. As shown in FIG. 6A and FIG. 6B, this is constituted for example by a first printhead H1000 that contains black ink. The printhead H1000 is securely supported on a carriage that is mounted on an inkjet printing apparatus by a positioning unit and electrical contact points, and is detachable with respect to the carriage. The printhead can be replaced when the ink with which it is filled is consumed and exhausted.

Below, detailed description in regard to the printhead H1000 is given of configuration elements that respectively constitute the printhead.

Printhead

The first printhead H1000 is a bubble jet (registered trademark) printhead that uses electrothermal transducers to generate thermal energy in order to produce film boiling in ink in response to electrical signals. Furthermore, it is a so-called side shooter type a printhead in which the electrothermal transducers and ink discharge orifices are arranged in opposition to each other.

(1) First Printhead H1000

Figure 7:
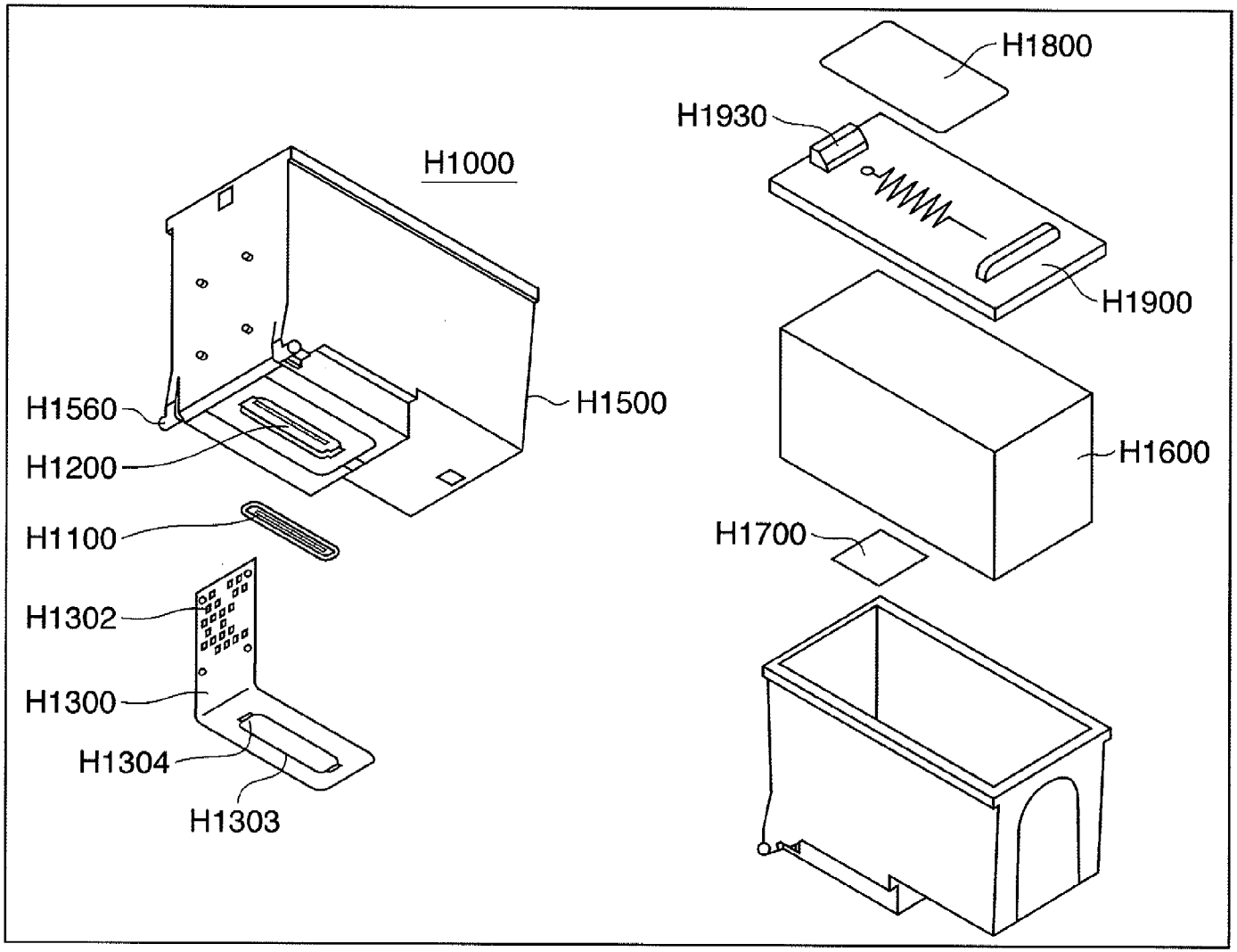
FIG. 7 depicts an exploded perspective view of the first printhead according to the exemplary embodiment of the present invention.

FIG. 7 depicts an exploded perspective view of the first printhead H1000. The printhead H1000 is provided with a first printing element substrate H1100, an electrical wiring tape H1300, and an ink supply holding member H1500. Further still, it is provided with a filter H1700, an ink absorber H1600, a lid member H1900, and a seal member H1800.

(1-1) First Printing Element Substrate H1100

Figure 8:
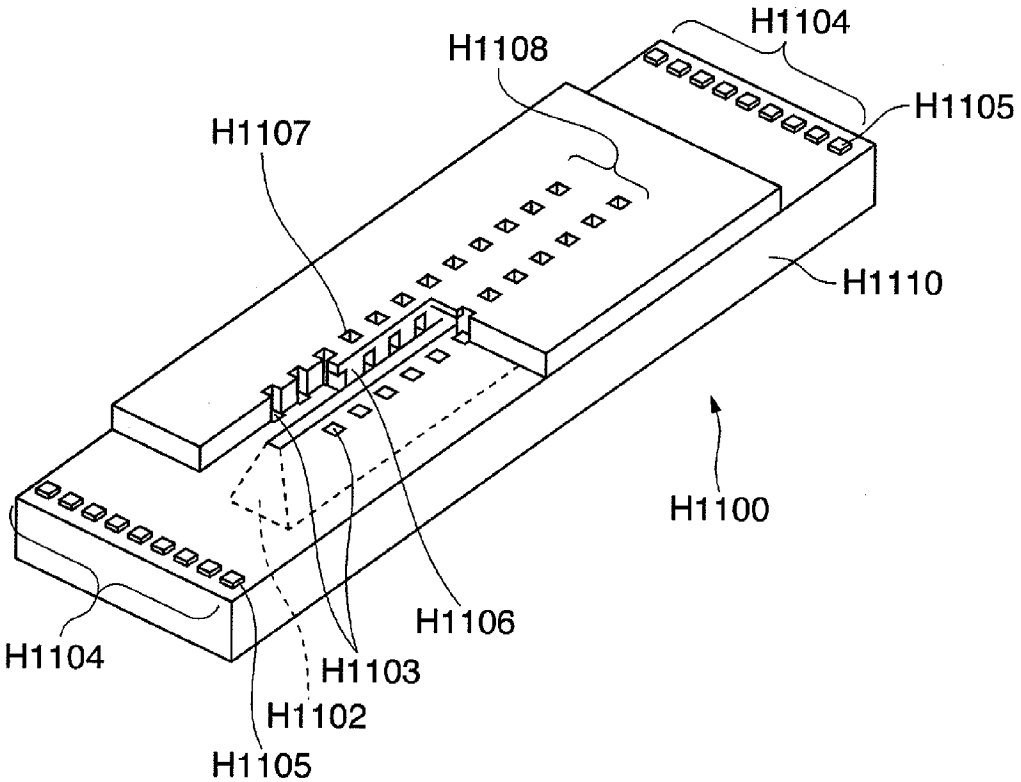
FIG. 8 depicts a ruptured perspective view of a portion of a first element substrate that constitutes the first printhead according to the exemplary embodiment of the present invention.

FIG. 8 is a diagram for describing a configuration of the first printing element substrate H1100 and depicts a perspective view showing a ruptured portion thereof. The first printing element substrate H1100 is a component in which an ink supply port H1102 having a long channel-shaped pass-through hole, which is an ink flow channel, is formed on an Si substrate H1110 having a thickness of 0.5 to 1 mm for example. The ink supply ports are formed by a technique such as anisotropic etching using Si crystal orientation or sandblasting.

Electrothermal transducers H1103, which are printing elements, and unshown drive elements for driving the transducers are arranged lined up in a single array, each on both sides of and sandwiching the ink supply port H1102 on the Si substrate H1110. Furthermore, not shown electrical wires made of Al or the like that supply electric power to the electrothermal transducers H1103 are further formed. These electrothermal transducers and electrical wires can be formed using known film forming techniques. Each array of electrothermal transducers is arranged to mutually form a zigzag pattern. That is, the positions of the discharge orifices of the arrays are arranged slightly displaced such that the directions orthogonal to the array directions do not line up.

Electrode portions H1104 are provided on the Si substrate for supplying electric power to the electrical wiring and for supplying electrical signals for driving the electrothermal transducers. The electrode portions are arranged in arrays along side areas positioned at both ends of the arrays of electrothermal transducers. Bumps H1105 constituted by Au or the like are formed on the electrode portions H1104 respectively.

A structure that provides an ink flow channel for each electrothermal transducer and that is constituted by a resin material is formed using a photolithographic technique on a surface where the pattern of printing elements such as wiring and resistor elements has been formed on the Si substrate H1110. This structure has ink flow channel walls H1106, which partition each ink flow channel, roof portions that cover thereabove, and discharge orifices H1107 are opened in the roof portions. The discharge orifices H1107 are arranged in opposition to the electrothermal transducers H1103 respectively, thereby forming a discharge orifice group H1108.

Due to the pressure of the bubble produced by the heat of the electrothermal transducers, the ink that has been supplied from the ink supply ports of the first printing element substrate is discharged from the discharge orifices H1107 that are in opposition to the electrothermal transducers.

(1-2) Electrical Wiring Tape H1300

The electrical wiring tape H1300 is a component in which electrical signal paths are formed that apply electrical signals to the first printing element substrate H1100 to discharge ink. Furthermore, an opening H1303 is formed for the first printing element substrate H1100 to be installed, and electrode terminals H1304 that connect to the electrode portions H1104 of the first printing element substrate H1100 are formed near edges of the opening H1303. Further still, external signal input terminals H1302 for receiving electrical signals from the printing apparatus are formed on the electrical wiring tape H1300, and the external signal input terminals H1302 and the electrode terminals H1304 are linked by a wiring pattern of contiguous copper foil.

The electrical connections between the electrical wiring tape H1300 and the first printing element substrate H1100 are achieved by electrically joining the bumps H1105 of the first printing element substrate H1100 and the electrode terminals H1304 of the electrical wiring tape H1300 using a thermal ultrasonic wave pressure bonding technique.

(1-3) Ink Supply Holding Member H1500

As shown in FIG. 7, the ink supply holding member H1500 functions as an ink tank by being provided with the ink absorber H1600 for holding the ink internally and producing a negative pressure. Furthermore, it serves a function of supplying ink by having formed therein ink flow channels for guiding the ink to the printing element substrate H1100.

An ink supply port H1200 for supplying black ink to the first printing element substrate H1100 is formed at a lower flow portion of the ink flow channel. Additionally, the first printing element substrate H1100 is adhered and secured to the ink supply holding member H1500 with very accurate positioning such that the ink supply port H1102 of the first printing element substrate H1100 communicates with the ink supply port H1200 of the ink supply holding member H1500.

Furthermore, a flat surface at a periphery of the adhered surface of the first printing element substrate H1100 and a portion of a back surface of the electrical wiring tape H1300 are further adhered and secured. The electrical connection portions of the first printing element substrate H1100 and the electrical wiring tape H1300 are sealed using a first sealant H1307 and a second sealant H1308 (see FIGS. 6A, 6B and FIG. 9). Due to these seals, the electrical connection portions are protected from ink corrosion and external impact.

Figure 9:
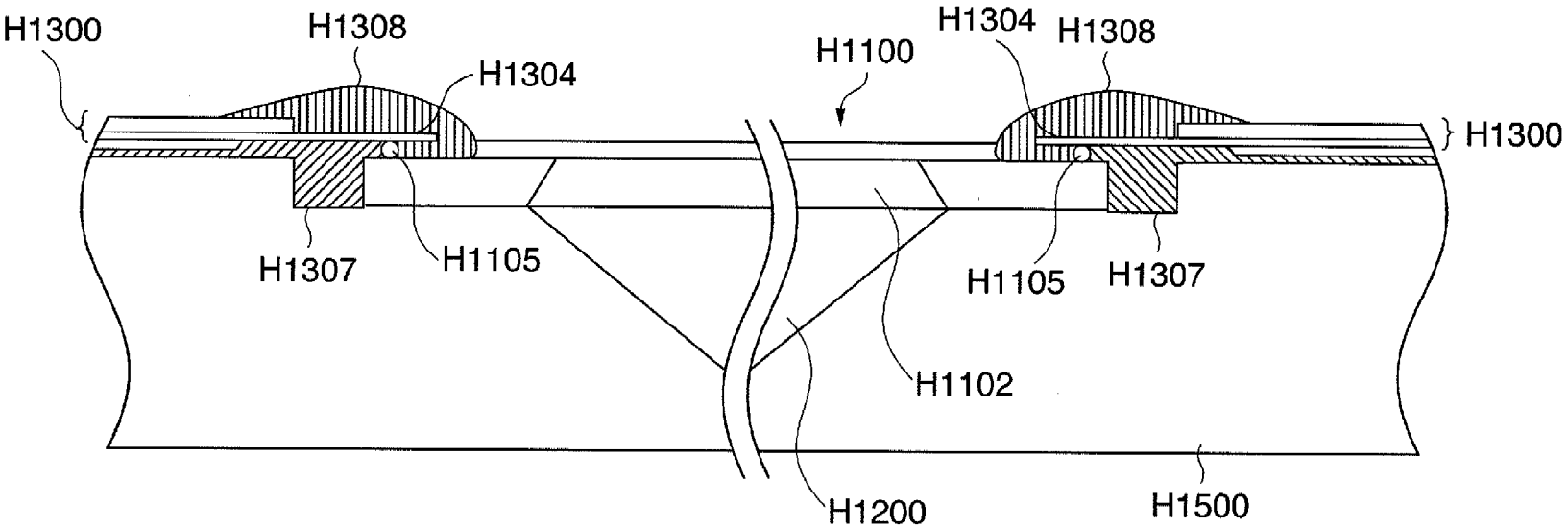
FIG. 9 depicts a cross-sectional view of a portion of the printhead according to the exemplary embodiment of the present invention.

FIG. 9 depicts a cross-sectional view of a portion of the printhead H1100. In FIG. 9, the same portions as those of other figures are shown by the same number of the other figures and descriptions of the portions are omitted.

Next, specific description is given regarding mounting the above-described printhead to the inkjet printing apparatus.

As shown in FIGS. 6A and 6B, the first printhead H1000 is provided with a mounting guide H1560 for guiding the head to amount position in the carriage in the inkjet printing apparatus. Furthermore, the first printhead is provided with an engaging portion H1930 for mounting and securing to the carriage using a head setting lever. Further still, a H1580 in the transport direction of the print medium, and an abutment portion H1590 in an ink discharge direction for positioning the head in a predetermined mount position in the carriage. By being positioned by these abutment portions, correct electrical contact becomes possible between the external signal input terminals H1302 on the electrical wiring tape H1300 and H1301 and the contact pins of electrical connection portions provided in the carriage.

Inkjet Printing Apparatus

Figure 10:
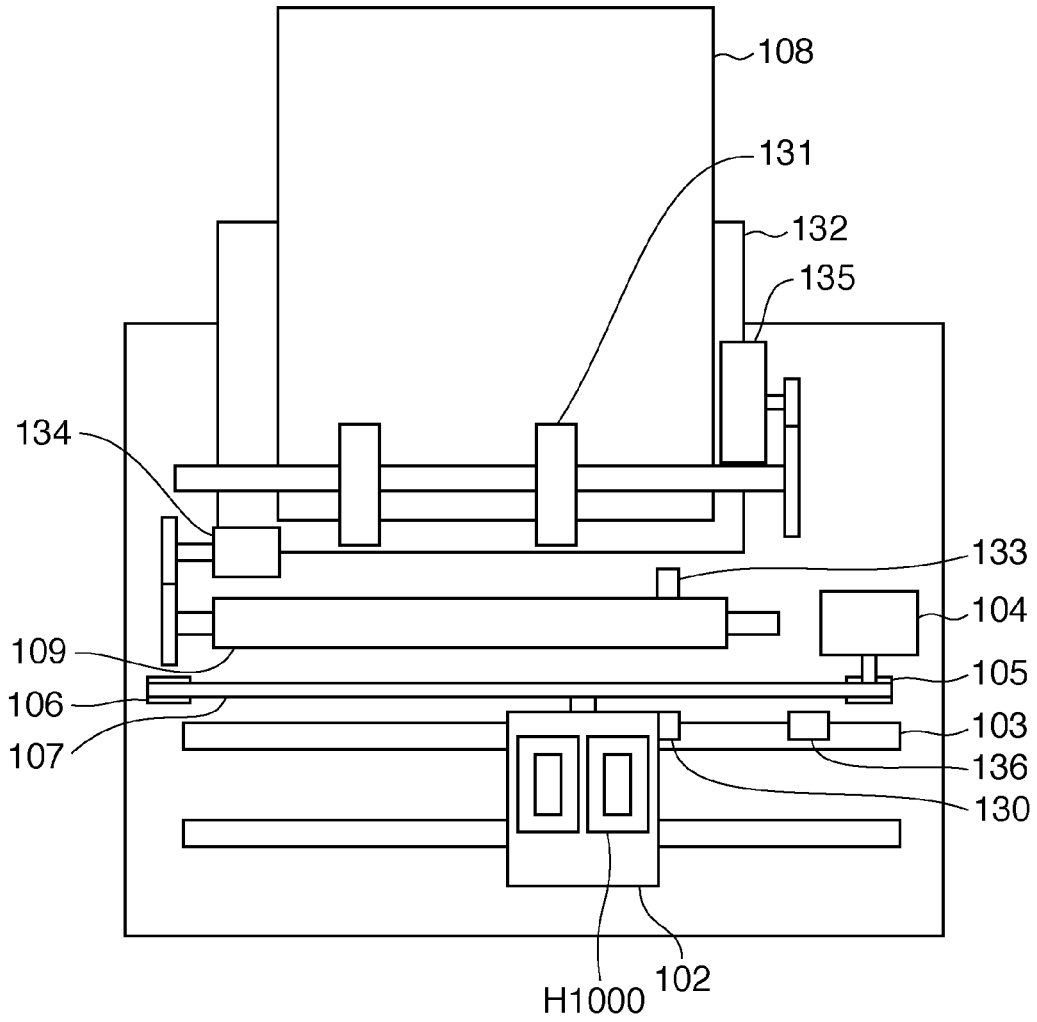
FIG. 10 is a schematic drawing showing one example of an inkjet printing apparatus according to the exemplary embodiment of the present invention.

Next, description is given regarding a liquid discharge printing apparatus in which the above-described cartridge type printhead is mountable. FIG. 10 is an explanatory diagram showing one example of a printing apparatus in which an inkjet printhead according to the present embodiment is mountable.

In reference to FIG. 10, the printing apparatus has a carriage 102 into which the printhead H1000 shown in FIGS. 6A and 6B is positioned and exchangeably mounted. Electrical connection portions are arranged in the carriage 102 for transmitting drive signals and the like to each discharge portion via the external signal input terminals of the printhead H1000. Various terminals such as logic power source output terminals and connection status input terminals are provided as the electrical connection portions, which connect to various terminals such as electric power input terminals for logic circuits and connection status output terminals of the element substrate to be described later.

The carriage 102 is supported so as to be capable of reciprocal movement along guide shafts 103, which are installed in the printing apparatus extending in the scanning direction. The carriage 102 is driven and its positioning and movement are controlled by a drive mechanism such as a motor pulley 105, an idling pulley 106, and a timing belt 107 driven by a carrier motor 104 or the like. Furthermore, a home position sensor 130 is provided for the carriage 102. A position that is the home position is detected when the home position sensor 130 on the carriage 102 passes a position of a closure plate 136.

In regard to a print medium 108 such as a print paper or a plastic thin board, a feed motor 135 causes a pickup roller 131 to rotate using a gear, then the print medium 108 is separated sheet by sheet from an auto sheet feeder (ASF) 132 and is fed. Further still, the print medium 108 is conveyed through a position (print area) in opposition to the discharge orifice surfaces of the printhead by rotation of a conveying roller 109. Drive from an LF motor 134 is transmitted to the conveying roller 109 by a gear. A determination of whether or not paper has been fed and an ascertainment of a sheet top detecting position during feeding are carried out at a point in time at which the print medium has passed a paper end sensor 133. The paper end sensor 133 is used for determining where the trailing edge of the print medium actually is and for finally calculating the current printing position from the actual trailing edge.

Control Configuration

Next, description is given regarding a control configuration for executing printing control of the above-described inkjet printing apparatus.

Figure 11:
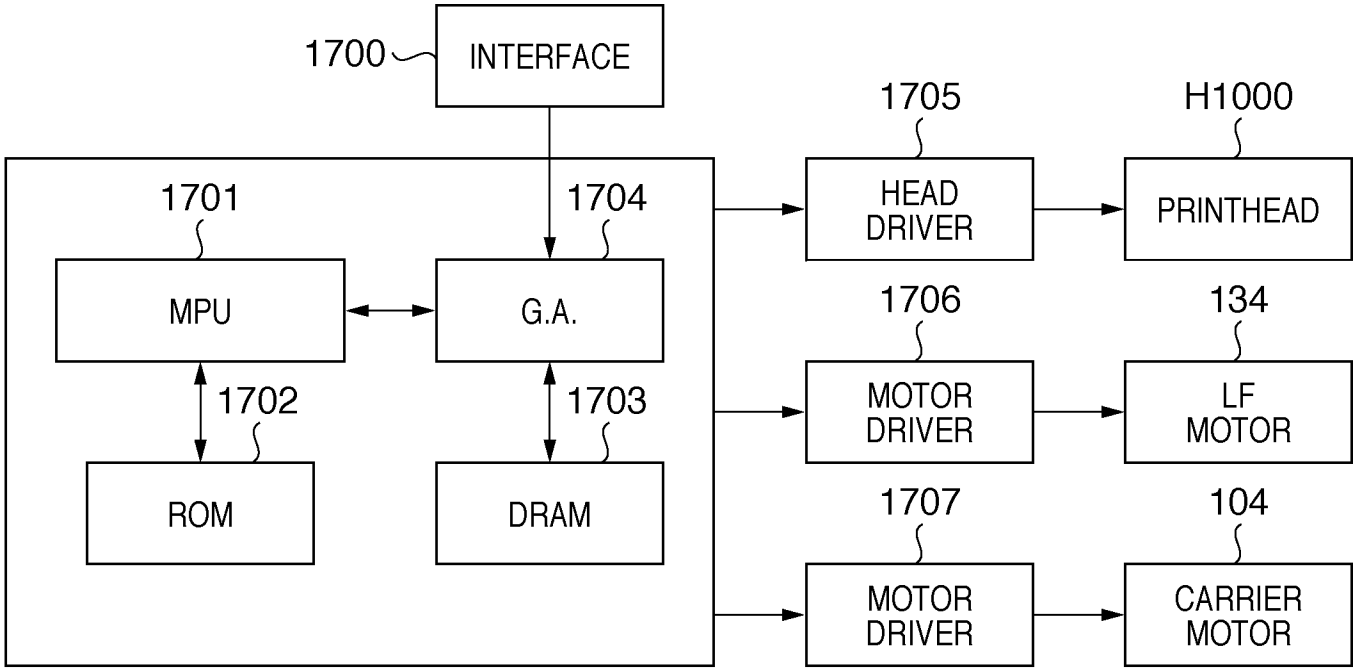
FIG. 11 is a diagram showing a configuration for control of the inkjet printing apparatus according to the exemplary embodiment of the present invention.

FIG. 11 is a block diagram showing a configuration of a control circuit of the inkjet printing apparatus.

In FIG. 11, numeral 1700 denotes an interface for inputting print signals, numeral 1701 denotes an MPU, and numeral 1702 denotes a ROM for storing control programs executed by the MPU 1701. Furthermore, numeral 1703 denotes a DRAM in which various types of data (print signals and the like to be supplied to the printhead H1000) are saved. Numeral 1704 denotes a gate array (GA) that carries out supply control of print signals to the printhead H1000, and also carries out data transfers among the interface 1700, the MPU 1701, and the RAM 1703. The carrier motor 104 is rotated to convey the printheads H1000 and H1001, and the LF motor 134 is rotated to convey a print media. Numeral 1705 denotes a head driver that drives the printhead H1000, numeral 1706 denotes a motor driver for driving the LF motor 134, and numeral 1707 denotes a motor driver for driving the carrier motor 104.

To describe an operation of the above-described control configuration, when a print signal comes into the interface 1700, the print signal is converted between the gate array 1704 and the MPU 1701 to a print signal for printing. Then, the motor driver 1706 and the motor driver 1707 are driven, and the printhead H1000 is driven in accordance with the print signal sent to the head driver 1705, thereby carrying out printing.

Embodiment

Figure 5:
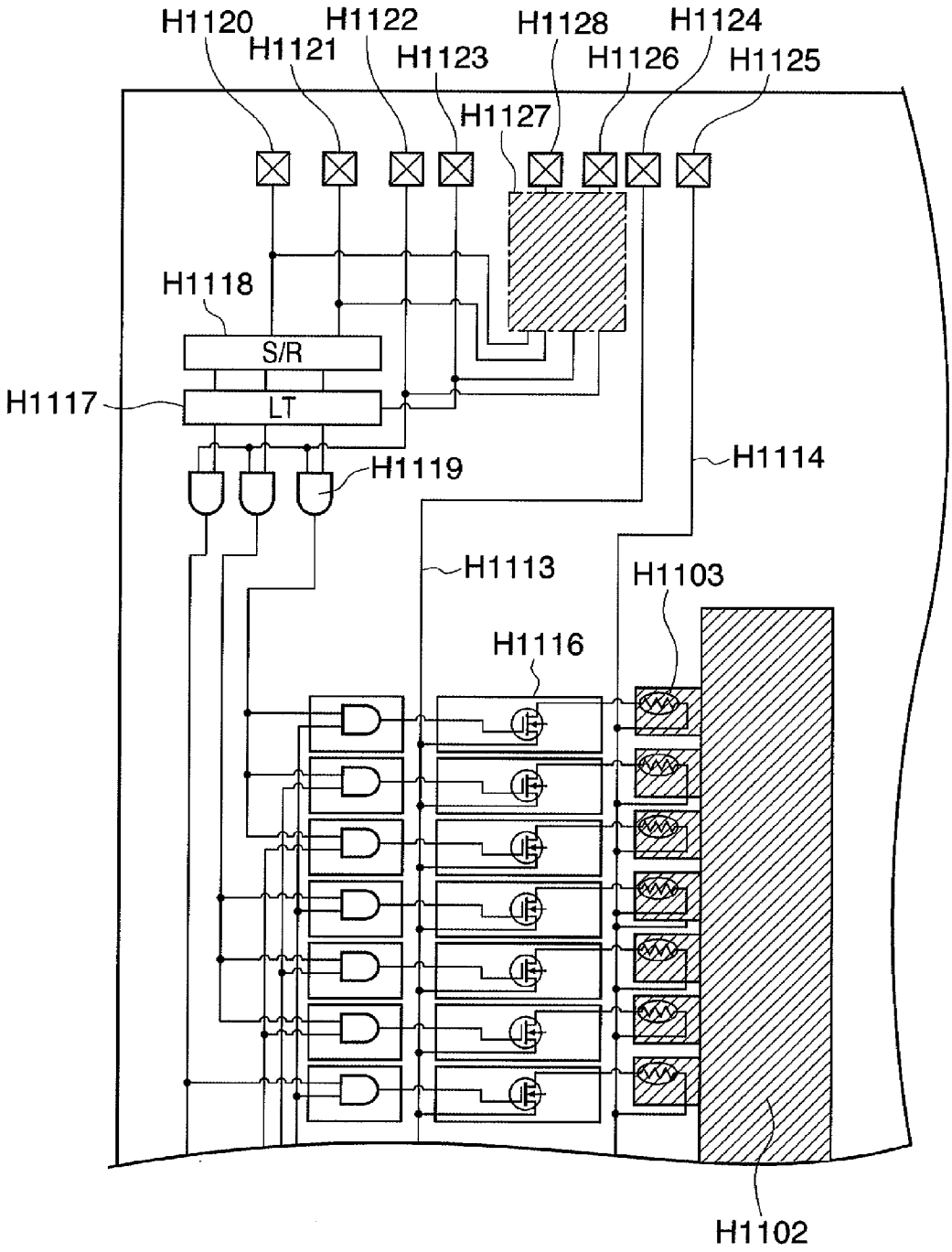
FIG. 5 is a diagram showing a circuit configuration example of an inkjet printhead according to the exemplary embodiment of the present invention.

FIG. 5 is a diagram showing a circuit configuration of the printing element substrate H1100 of the printhead H1000 according to the embodiment. It should be noted in regard to the first printing element substrate H1100 that semiconductor elements and wiring are formed on the Si substrate H1110 in a semiconductor process. In the printhead according to the present embodiment, n-number of nozzles are provided in each array for the ink supply port H1102. Each of these nozzles is provided with an electrothermal transducer H1103, which is capable of heating the ink in the nozzle, and a drive element H1116 that drives the electrothermal transducer H1103. The electrothermal transducer H1103, the drive element H1116, and the ink discharge nozzle are referred to together as a printing component.

Figure 2:
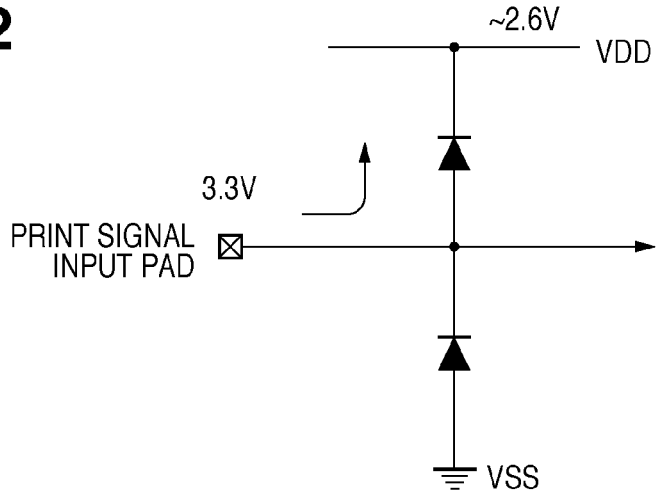
FIG. 2 PRIOR ART
FIG. 2 is a diagram showing a configuration example of a conventional electrostatic protection circuit.
Figure 3:
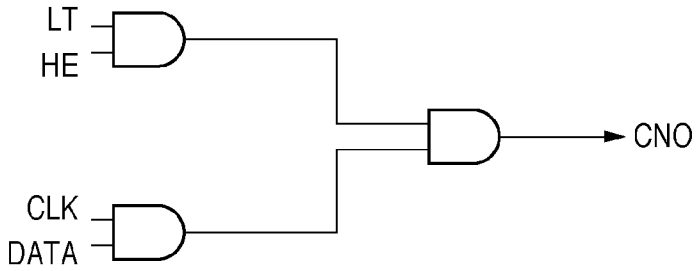
FIG. 3 PRIOR ART
FIG. 3 is a diagram showing an example of a conventional connection status output circuit.

A print signal input terminal H1121 is provided on the printhead as an electrical contact point with the printing apparatus and inputs a print signal (DATA). Furthermore, a clock signal input terminal H1120 is provided for inputting a clock signal (CLK), which is synchronized to the print signal and is for inputting the print signal. Furthermore, a latch signal input terminal H1123 is provided for inputting a latch signal (LT) to a latch circuit H1117. Furthermore, a drive signal input terminal H1122 is provided for inputting a heat signal (HE) to put the drive elements H1116 that drive the electrothermal transducers H1103 into an enabled state. Furthermore, an electric power input terminal H1128 for the logic circuits is provided for supplying a logic power source (VDD), which is a voltage applied to the logic circuits. Further provided are an electric power source wiring terminal H1124 of the electrothermal transducers H1103, and a power source wiring terminal H1125 of the electrothermal transducers H1103 on the ground side. It should be noted that symbol H1113 denotes an electric power source wiring of the electrothermal transducers H1103 and symbol H1114 denotes an electric power source wiring of the ground side. Furthermore, diodes are arranged as protection elements as shown in FIG. 2 in the vicinity of the print signal input terminal H1121, the clock signal input terminal H1120, the latch signal input terminal H1123, and the drive signal input terminal H1122. Furthermore, divided driving is employed in the printhead shown in FIG. 5 by performing driving by dividing the n-number of printing components into a plurality of blocks.

Driving of the printhead is implemented using a following procedure.

The print signal is supplied in synchronism with the clock signal inputted from the clock signal input terminal H1120 and inputted by the print signal input terminal H1121, then the print signal is successively held in a shift register H1118. A latch signal is inputted via the latch signal input terminal H1123 after print signal of a predetermined bit is held in the shift register H1118, then the latch circuit H1117, which is arranged at a next stage of the shift register H1118, latches the print signal in accordance with the latch signal. Furthermore, a part of the print signal is supplied to a decoder (not shown) as a block selection signal (BLE) for dividing and driving the n-number of electrothermal transducers H1103. Of the printing components selected by the block selection signal, printing components are driven that have been selected according to an output from an AND circuit H1119, which calculates a logical product of a heat signal inputted to the drive signal input terminal H1122 and the print signal outputted by the latch circuit H1117. Printing is carried out by discharging ink from the nozzles corresponding to these printing components. Here, while the printing components are being driven, the print signal, the clock signal, the latch signal, and the drive signal for carrying out the next printing are inputted to the printhead.

Next, description is given regarding a procedure for confirming the electrical connection status between the printhead H1000 and the inkjet printing apparatus.

The printhead H1000 is mounted on the carriage 102 of the printing apparatus shown in FIG. 10. Contact portions (not shown) are arranged between the carriage 102 and the printhead H1000 for connecting the electrical contact points to each other. Accordingly, when the printhead H1000 mounts onto the carriage 102, contact is made with the external signal input terminals H1302, which are arranged on the printhead H1000 and transmit and receive various types of electrical signals, and electrical connections are achieved. The printhead H1000 is provided with a connection status output circuit H1127 (FIG. 5) as a means for confirming the electrical connection status with the printing apparatus and a connection status output terminal H1126 (CNO) that outputs a calculation result of this circuit to the printing apparatus.

Figure 1A:
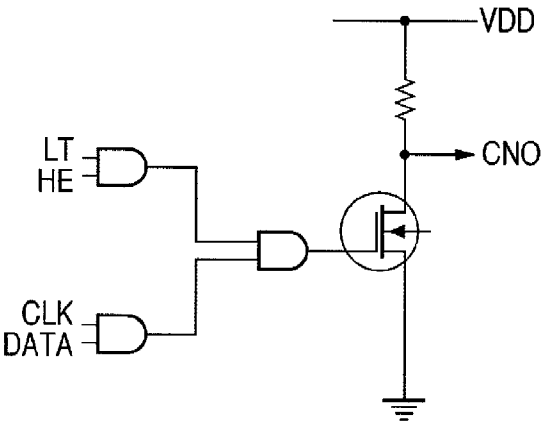
FIG. 1A is a diagram showing a configuration of a connection status output circuit according to an exemplary embodiment of the present invention.

The connection status output circuit H1127 according to the present working example is shown in FIG. 1A. The connection status output circuit H1127 is provided with a first AND circuit, which calculates a logical product of the print signal (DATA) and the clock signal (CLK), and a second AND circuit, which calculates a logical product of the latch signal (LT) and the heat signal (HE). Further still, the connection status output circuit H1127 is provided with a third AND circuit that calculates a logical product of calculation results of the first and second AND circuits. The calculation result of the third AND circuit is supplied to a gate of an NMOS transistor. It should be noted that the drain of the NMOS transistor is connected to the logic power source input terminal H1128 (VDD) via a resistor and its source is connected to a ground. In this manner, the signal outputted from the connection status output terminal H1126 is outputted by undergoing voltage division between the logic power source input terminal and the drain and between the drain and the source. With this configuration, either a signal having a first level based on a voltage (VDD) applied to the electric power source input terminal for the logic circuits, or a signal having a second level based on a voltage of the print signal or the like inputted to the input terminals, can be outputted from the connection status output terminal H1126 in accordance with a level of the signal inputted to the gate of the NMOS transistor. In this manner, the connection condition of the electric power source (VDD) for the logic circuits can be confirmed independently.

Figure 1B:
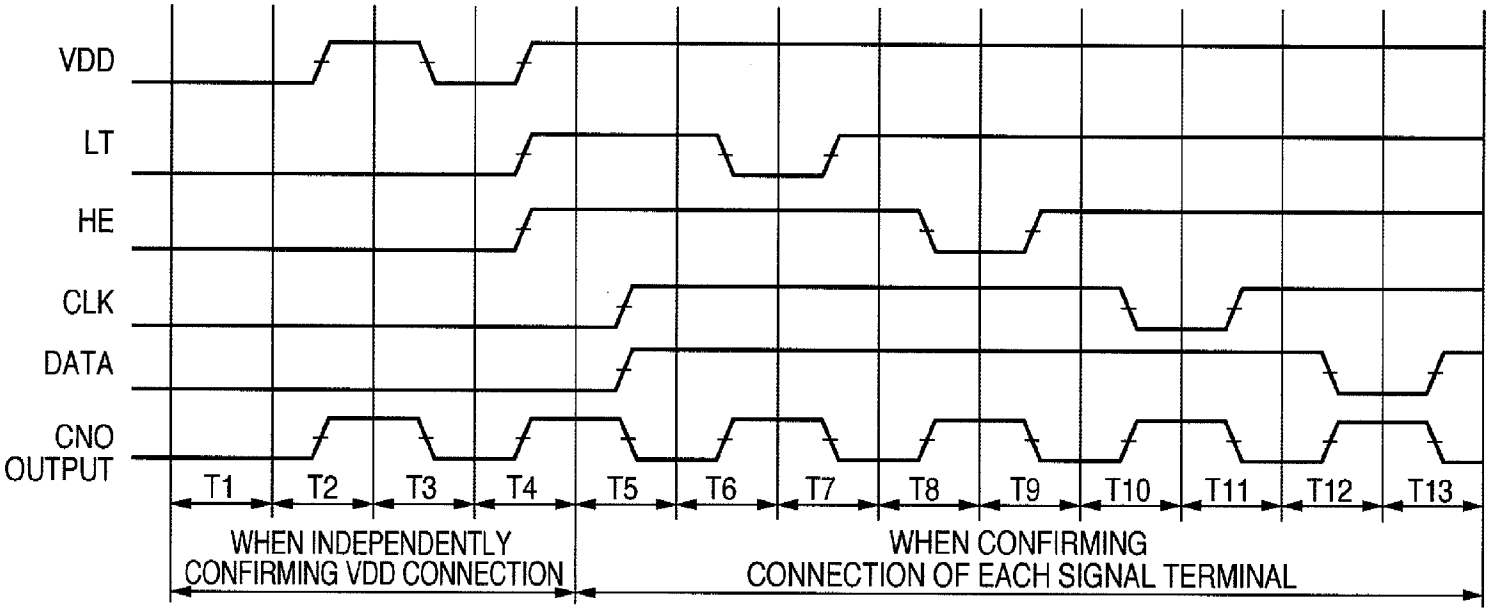
FIG. 1B is a diagram showing timings of signals of the connection status output circuit according to the exemplary embodiment of the present invention.

FIG. 1B is a timing chart of signals inputted from the printing apparatus to the printhead and an output signal (CNO signal) outputted by the connection status output terminal H1126 when confirming the connection status of the printhead and the printing apparatus. Here, the latch signal (LT) and the drive signal (HE), which are controlling signals, are negative logic (low active) that are ON when the signal is low. Negative logic refers to a high state due to a pull-up resistor when there is no signal, that is, when the logic is "false (0)," and a low state when the logic is "true (1)." It should be noted that the print signal (DATA) and the clock signal (CLK) are positive logic (high active) that are ON when their signals are high, and are connected to pull-down resistors such that there is a GND level when there is no signal. This is because in a case where all the signals are positive logic, drive control of the printing components becomes impossible when all the signals are high for some reason. Signals having different logic are used in order to prevent such a situation, and since an ordinary noise margin is effective, the latch signal (LT) and the drive signal (HE), which are controlling signals, are set to negative logic, and the clock signal (CLK) and the print signal (DATA) are set to positive logic.

First, description is given regarding a method for independently confirming a VDD connection status. In an initial state, namely a time period T1, the input signal from each of the signal terminals is in a low state, and the VDD is also in a low state. In independently confirming the VDD connection, the input signals from the signal terminals are all maintained in a low state, then in a time period T2, a signal from the VDD terminal is inputted and the VDD is put into a high state. As a result, the CNO output is outputted in a high state and it is possible to confirm the electrical connection between the VDD terminal of the printhead and the printing apparatus. After CNO output has been able to be correctly confirmed on the printing apparatus in the time periods T1 to T4, a confirmation of the connection status of each of the signal terminals is carried out.

A method for confirming the connection status of the signal terminals first involves setting all of the print signal (DATA), the clock signal (CLK), the latch signal (LT), the drive signal (HE), and the logic power source VDD temporarily to a high state in a time period T5, thereby causing the CNO output to be outputted in a low state. Here, only the LT signal is inputted in a low state from the printing apparatus to the printhead in the time period T6. If the CNO output becomes high state when synchronized to the LT signal, then connection has been achieved correctly, and the printing apparatus determines the connection status by confirming this logic. Similarly, in the time periods T8 to T13, confirmations are carried out as to whether or not the logic input terminals are connected separately.

Figure 12:
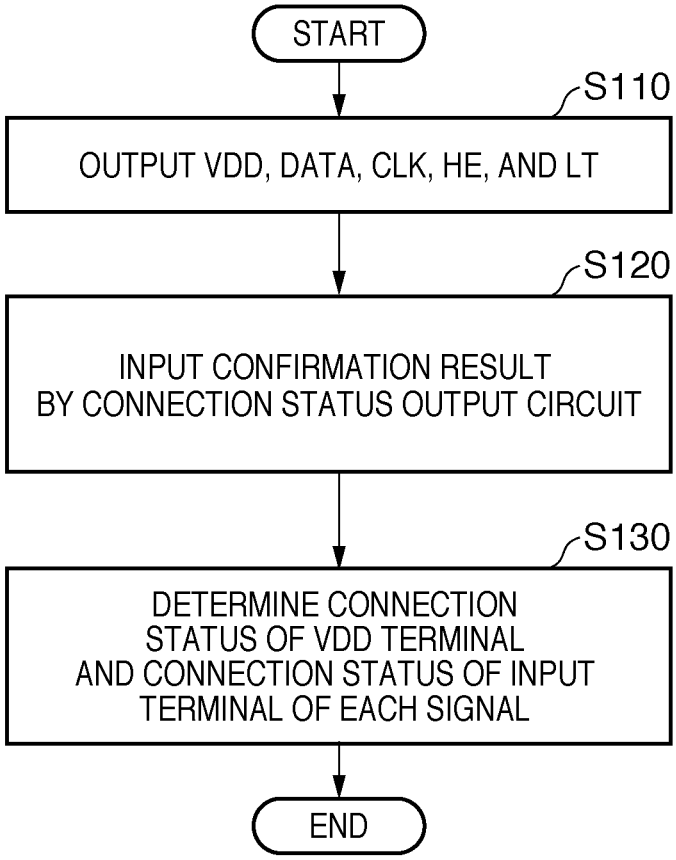
FIG. 12 is a flowchart of a procedure of confirming an electrical connection status of a printhead in the inkjet printing apparatus according to the exemplary embodiment of the present invention.

FIG. 12 shows a flowchart of the above-described procedure of confirming an electrical connection status of a printhead in the inkjet printing apparatus according to the embodiment.

First, in step S110, the VDD, DATA, CLK, HE, and LT signals are outputted to the element substrate. Next, in step S120, a confirmation result according to the connection status output circuit H1127 of the element substrate is inputted. Then, in step S130, determinations are performed independently by the MPU 1701 or the like of the electrical connection status of the VDD terminal and the electrical connection status of the input terminals of the signals respectively. It should be noted that in the present embodiment, a confirmation of the electrical connection status of the VDD terminal is carried out before the confirmation of the electrical connection status of the input terminals of the signals, but this may be carried out in a reverse order.

By carrying out the above-described processing at a time of turning on power to the printing apparatus or prior to a printing operation, it is possible to prevent printing problems such as missing print dots, and damage to the printhead originating in contact point problems.

Figure 4:
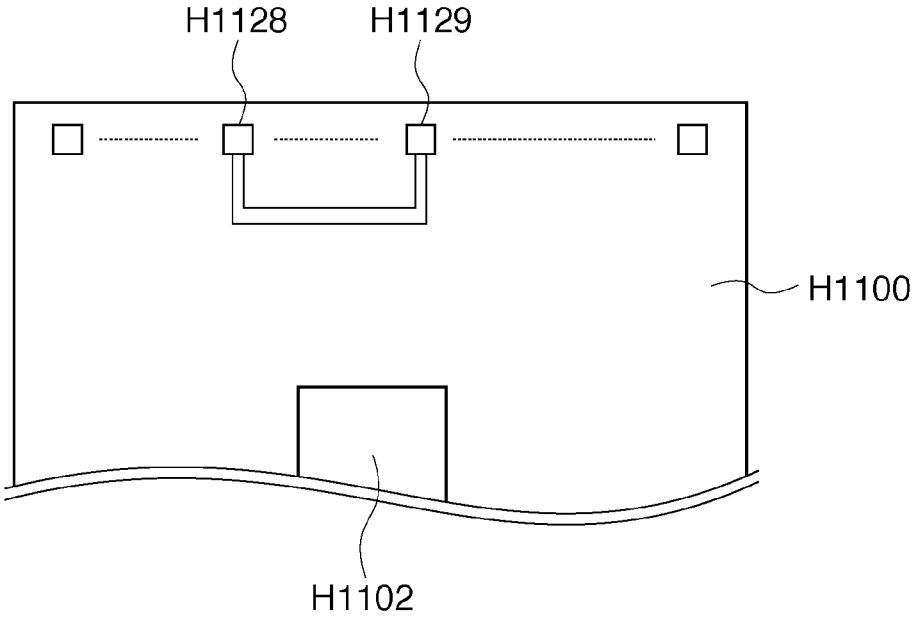
FIG. 4 is a diagram showing an example of a connection status output circuit according to the exemplary embodiment of the present invention.

A method is shown in FIG. 4 as a different method for independently carrying confirmation of the connection status of the logic power source (VDD). Specifically, this is a method using a configuration in which a direct connection is performed from the logic power source input terminal H1128, which is the input terminal of the VDD signal in the printing element substrate, to a terminal H1129 for confirming connection. This configuration is a configuration in which the input terminal H1128 of the VDD signal and the terminal H1129 for confirming connection are directly connected and therefore a circuit configuration in the first inkjet printing element substrate becomes the simplest configuration. However, since the terminal H1129 for confirming connection is newly provided, one terminal is newly provided and there is a possibility that a size of the element substrate may be affected. In contrast to this, with the present embodiment there is a configuration in which an existing connection status output circuit is improved as shown in FIG. 1A, and therefore it is not necessary to provide a new terminal, which makes it possible to achieve improved reliability without increasing the size of the element substrate.

Furthermore, in addition to an image output terminal of an information processing device such as a computer integrally or separately provided as an embodiment of the printing apparatus according to the present embodiment, other embodiments include a copying apparatus combined with a reader or the like, and further still a facsimile machine having a transmission and reception function.

Furthermore, the aforementioned embodiment was described using an example of an element substrate for an inkjet printhead, but this can also be used in an element substrate for a thermal transfer method printhead or a sublimation type printhead or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An element substrate comprising:

a plurality of printing elements;

a logic circuit configured to control driving of the printing elements;

a plurality of input signal terminals configured to respectively input a plurality of signals;

an input power terminal configured to input a voltage to be applied to the logic circuit;

a logical operation circuit configured to perform a logical operation of the plurality of signals and output result of the logical operation;

a switch configured to, wherein a first terminal of the switch connecting to the input power terminal, a second terminal of the switch connecting to a ground, and a third terminal of the switch receiving the result of the logical operation, generate a status signal according to the result of the logical operation; and an output signal terminal configured to output the status signal, wherein the switch changes a level of the status signal when the plurality of signals are not input and the voltage is applied via the input power terminal, and the switch changes the level of the status signal in accordance with the result of the logical operation in a case that the voltage is being applied to the logic circuit via the input terminal.

2. An element substrate according to claim 1, wherein the switch includes a transistor, and the third terminal is a gate terminal of the transistor.

3. An element substrate according to claim 1, wherein the switch includes a NMOS transistor, the first terminal is a drain terminal of the NMOS transistor, the second terminal is a source terminal of the NMOS transistor, and the third terminal is a gate terminal of the NMOS transistor.

4. An element substrate according to claim 1, wherein the first terminal connects to the input power terminal via a resister.

5. An element substrate according to claim 1, the logic circuit includes a shift register and a latch circuit.

6. A printhead comprising:

a plurality of printing elements;

a logic circuit configured to control driving of the printing elements;

a plurality of input signal terminals configured to respectively input a plurality of signals;

an input power terminal configured to input a voltage to be applied to the logic circuit;

a logical operation circuit configured to perform a logical operation of the plurality of signals and output result of the logical operation;

a switch configured to, wherein a first terminal of the switch connecting to the input power terminal, a second terminal of the switch connecting to a ground, and a third terminal of the switch receiving the result of the logical operation, generate a status signal according to the result of the logical operation;

an output signal terminal configured to output the status signal, wherein the switch changes a level of the status signal when the plurality of signals are not input and the voltage is applied via the input power terminal, and the switch changes the level of the status signal in accordance with the result of the logical operation in a case that the voltage is being applied to the logic circuit via the input terminal.

* * * * *